US006325031B1

(12) United States Patent
Takano

(10) Patent No.: US 6,325,031 B1
(45) Date of Patent: Dec. 4, 2001

(54) ENGINE CAM SHAFT DRIVE INCORPORATING VVT

(75) Inventor: Tomotaka Takano, Iwata (JP)

(73) Assignee: Yamaha Hatsudoki Kabushiki Kaisha, Iwata (JP)

( * ) Notice: Subject to any disclaimer, the term of this patent is extended or adjusted under 35 U.S.C. 154(b) by 0 days.

(21) Appl. No.: 09/643,814

(22) Filed: Aug. 22, 2000

(30) Foreign Application Priority Data

Sep. 3, 1999 (JP) ..... 11-249736

(51) Int. Cl.[7] ..... F01L 1/344
(52) U.S. Cl. ..... 123/90.17; 123/90.31
(58) Field of Search ..... 123/90.15, 90.17, 123/90.31

(56) References Cited

U.S. PATENT DOCUMENTS 4,805,566 * 2/1989 Ampferer ..... 123/90.15
5,184,581 * 2/1993 Aoyama et al. ..... 123/90.31
5,954,019 * 9/1999 Yoshikawa et al. ..... 123/90.17
6,035,817 * 3/2000 Uchida ..... 123/90.17
6,062,183 * 5/2000 Sato et al. ..... 123/90.17
6,076,492 * 6/2000 Takahashi ..... 123/90.17
6,135,077 * 10/2000 Moriya et al. ..... 123/90.17

FOREIGN PATENT DOCUMENTS

0808997 A 11/1997 (EP) .
0863297 A 9/1998 (EP) .
1013899 A 6/2000 (EP) .

* cited by examiner

*Primary Examiner*—Weilun Lo
(74) *Attorney, Agent, or Firm*—Ernest A. Beutler

(57) ABSTRACT

A variable valve timing mechanisms for an internal combustion engine wherein the timing of two cam shafts associated with the same combustion chamber of the engine may be driven at the same time interval and at the same speed from the engine output shaft and both cam shafts may have their timing adjusted simultaneously by a first variable valve timing mechanism and only one of the cam shafts may have its timing adjusted relative to the other cam shaft by a second variable valve timing mechanism to provide a simpler operational control and lower cost assembly. The variable valve timing cam drive arrangement also reduces the loading on the cam shaft bearings.

8 Claims, 3 Drawing Sheets

ENGINE CAM SHAFT DRIVE INCORPORATING VVT

BACKGROUND OF THE INVENTION

This invention relates to an internal combustion engine and more particularly to a cam shaft drive incorporating a variable valve timing mechanism for operating the valves of such an engine.

It is well known that one of the factors that controls the performance of an internal combustion engine is the valve timing. Generally, the valves are operated by one or more cam shafts at a timed relationship to the rotation of the engine output shaft. Frequently, the intake valves are operated by the cam shaft that is different from that which operates the exhaust valves. Generally, the optimal valve timing for an engine varies, depending upon the speed and load at which the engine is operating. Thus, conventional engines having fixed valve timing arrangement generally are designed to provide a comprise between good running at low speeds and low loads and maximum engine output. Depending upon the use of the engine, the bias may be toward one or the other end of these two alternative ranges.

In order to improve performance over a wider range of engine speed and load conditions, it has been proposed to employ a variable valve timing arrangement (VVT) in the drive for the cam shafts. In this way, the timing relationship of the cam shafts can be adjusted so as to provide optimal performance for more running condition.

The variable valve timing mechanisms which have been proposed generally fall into two categories. With the first of these and the simpler arrangement, the timing of both cam shafts is generally altered in the same direction and at the same degree. This is done by interposing one variable valve timing mechanism in the timing drive between the engine output shaft and the cam shafts. This has the advantages of simplicity, lower cost and still provides greater flexibility in engine performance.

The other type of system includes a variable valve timing mechanism that is interposed between the drive for each of the cam shafts from the output shaft. This obviously doubles the number of components, including the control mechanism. It does, however, offer the possibility of a greater flexibility in overall engine performance.

It has been discovered, however, that there are a number of running conditions where the performance is optimal if both cam shafts are adjusted at the same phase angle. Other running conditions require a different adjustment between the cam shafts. Although this can be employed were it easily in an arrangement wherein there are independent variable valve timing mechanisms associated with each cam shaft, this makes the control strategy more complicated.

There has been proposed, therefore, an improved variable valve timing mechanism for an engine wherein two cam shafts may have their timing altered simultaneously or independently of each other, depending upon the running characteristics. Several embodiments of ways of accomplishing this are disclosed in the copending application of Kaoru Okui and Masahiro Uchida, entitled "Variable Valve Timing Mechanism for Engine", Ser. No. 09/471,887, filed Dec. 23, 1999, now U.S. Pat. No. 6,250,266, and assigned to the assignee hereof.

It is an object of this invention to provide an additional embodiment of cam shaft drives that permit either simultaneous adjustment of the timing of both cam shafts or independent adjustment of the timing of the cam shafts relative to each other to those disclosed in the aforenoted co-pending application.

All of the embodiments in the aforenoted co-pending application employ plural chain drives for driving two cam shafts from the crankshaft. When chain drives are employed, they generally are positioned within the engine body and receive lubricant from the engine lubricating system for their lubrication. This has some disadvantages with servicing and can present some objectionable driving noise.

It is, therefore, a still further object to this invention to provide a variable cam shaft driving mechanism wherein the timing of the cam shafts can be adjusted simultaneously or independently and wherein at least part of the drive is through a toothed belt that need not be enclosed within the body of the engine.

Where a flexible driving belt is employed, it is desirable to maintain a short length for this belt in order to reduce the effects of belt stretch or elongation and to simply the driving arrangement. It is, therefore, a still further object to this invention to provide an improved variable valve timing drive for the cam shafts of an engine where at least part of the drive is accomplished through a drive belt that is maintained with a relatively short length.

In the drive mechanism shown in the aforenoted co-pending application, the cam shaft drives are all cantilevered on the outer end of the cam shafts and at a point spaced outwardly from the forward most journal therefore. This tends to put large bending loads on the cam shafts and also on the bearing surfaces.

It is, therefore, a still further object of this invention to provide a variable valve timing cam drive arrangement of this general type wherein the loading on the cam shaft bearing is reduced.

It is a further object of this invention to provide an improved cam shaft variable valve timing mechanism wherein simultaneous adjustment of both cam shafts can be accomplished through the use of one variable valve timing mechanism and adjustment of the timing of the cam shafts relative to each other is done by a separate variable valve timing mechanism.

SUMMARY OF THE INVENTION

This invention is adapted to be embodied in an internal combustion engine and cam shaft timing drive therefore. The engine comprises an output shaft that is driven by combustion occurring in at least one combustion chamber of the engine. A first cam shaft operates at least one valve associated with the combustion chamber. A second cam shaft operates at least a second valve also associated with the combustion chamber. The first and second cam shafts are journalled at one end thereof by a bearing arrangement formed by the engine. A first cam shaft drive is provided for driving one of the cam shafts on one side of the bearing arrangement from the engine output shaft and for driving a driven member journalled on the other of said cam shafts. A first variable valve timing mechanism interconnects the first cam shaft drive to the one cam shaft for varying the phase angle of the one cam shaft relative to the engine output shaft. A second cam shaft drive is provided on the other side of the bearing arrangement from the first cam shaft drive and drives the other cam shaft from the one cam shaft. A second variable valve timing mechanism is interposed between this second cam shaft drive and the other cam shaft for varying the phase relationship of the other cam shaft relative to the one cam shaft.

In accordance with the preferred embodiment of the invention that is illustrated, the first and second cam shafts each drive either intake or exhaust cam shafts. Although such an arrangement is possible, it also may be desirable to operate the valves of a multiple valve engine so that the timing of valves that serve the same function (either intake valves or exhaust valves), can have their timing adjusted either simultaneously or independently of each other. Thus, although the illustrated embodiment shows an arrangement wherein the intake and exhaust valves are timed separately, the invention also may be practiced with engines where valves that serve the same function (either intake or exhaust or both) can be operated simultaneously or independently. The structure for accomplishing this should be readily apparent from the description of the preferred embodiment which is disclosed.

DETAILED DESCRIPTION OF THE PREFERRED EMBODIMENT OF THE INVENTION

Figure 1:
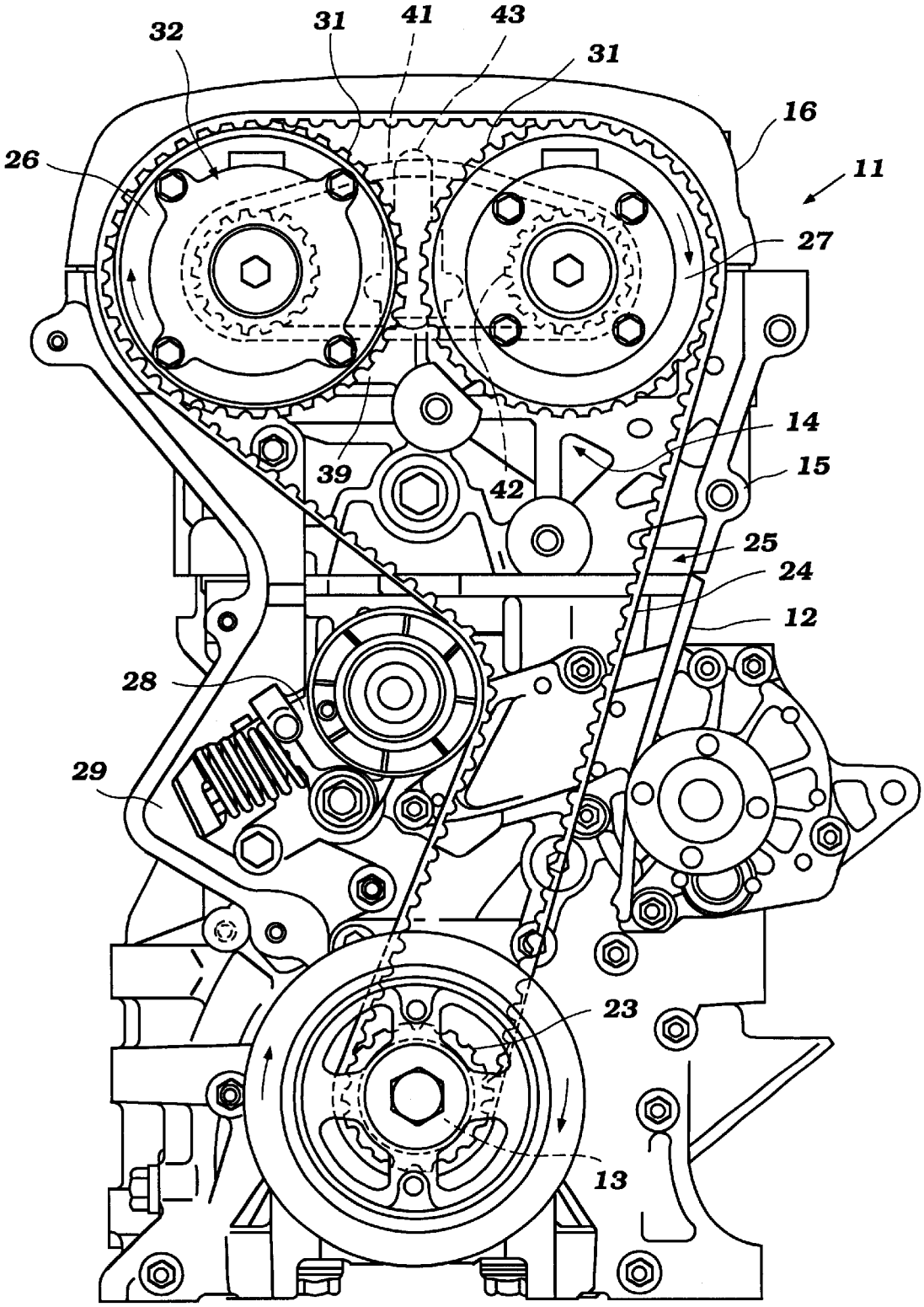
FIG. 1 is an end elevational view of an internal combustion engine constructed in accordance with a preferred embodiment of the invention with the timing cover removed.
Figure 2:
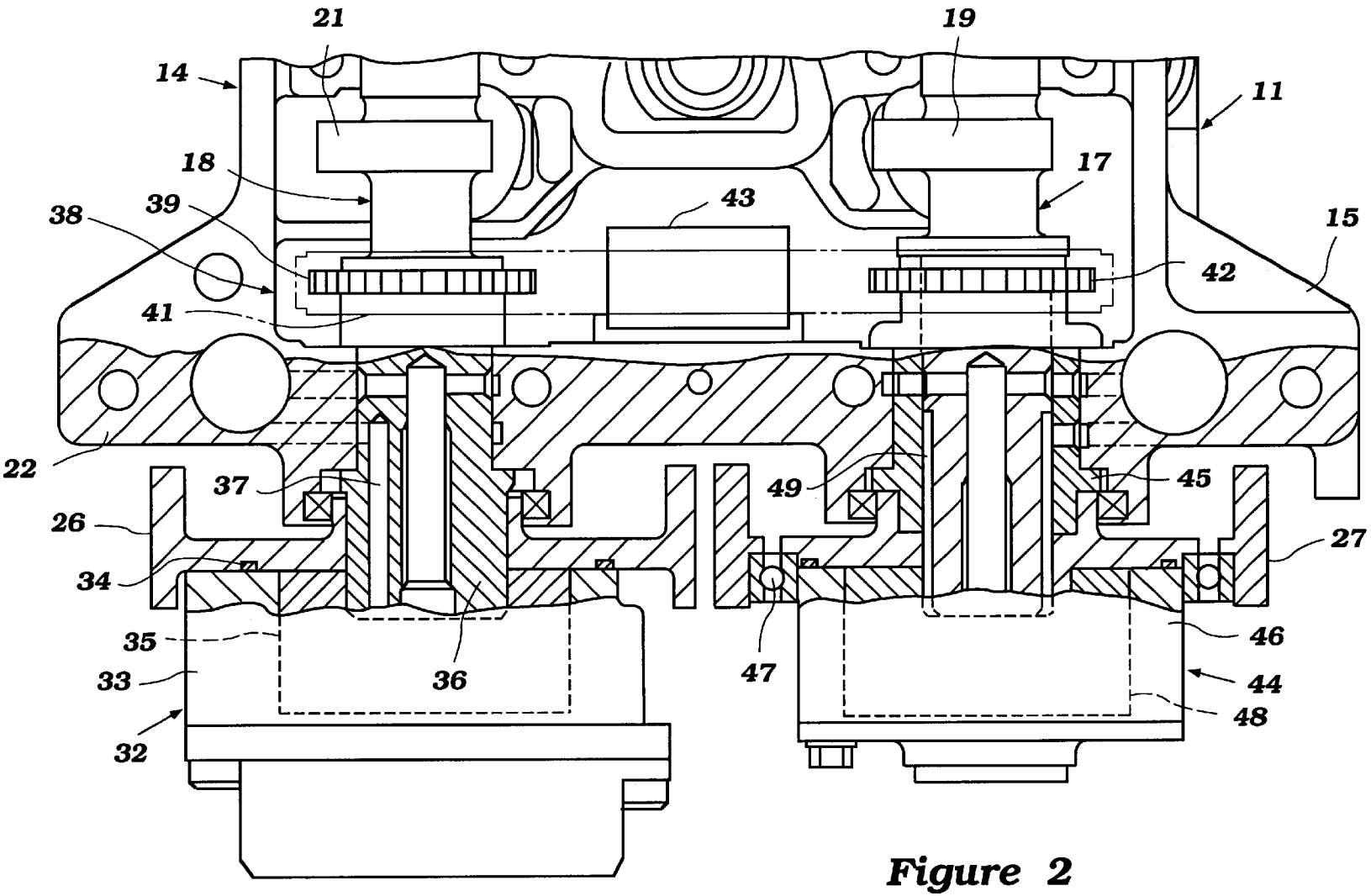
FIG. 2 is a top plan view of the engine shown in FIG. 1, illustrating the cylinder head and the cam shaft driving mechanism with certain components of the cylinder head assembly removed and others broken away or shown in phantom so as to more clearly show the variable valve timing mechanism drive.

An internal combustion engine constructed in accordance with a first embodiment of the invention is shown in FIGS. 1 and 2 and is identified generally by the reference numeral 11. The engine 11 is, in this embodiment, illustrated as being of the inline type. Although such an engine configuration is illustrated, it will be readily apparent to those skilled in the art how the invention can be practiced with engines having various numbers of cylinders and other cylinder configurations.

The engine 11 is comprised of a cylinder block assembly, identified by the reference numeral 12. This cylinder block assembly 12 forms a plurality of aligned cylinder bores. Pistons (not shown) reciprocate in these cylinder bores and are connected by connecting rods (not shown) to the throws of a crankshaft 13 which is journaled for rotation in a suitable manner in the crankcase assembly of the cylinder block 12. Since the internal construction of the cylinder bores may be of any known type, and since the invention can be utilized with a wide variety of types of engines, this construction is not illustrated. Those skilled in the art will readily understand how to use the invention with a wide variety of types of engine constructions.

A cylinder head assembly 14 is affixed in a suitable manner to the cylinder block 12 and close the upper ends of the cylinder bores therein. Again, the actual formation of the combustion chambers and the valve arrangement associated therewith may be of any known type. The cylinder head assembly 14 includes a main cylinder head member 15 and a cam cover 16 that is detachably connected thereto and which confines the valve operating mechanism, which will be described shortly by additional reference to FIG. 2.

The engine is arranged so that one side of the cylinder head assembly 14 comprises the intake side of the cylinder head assembly 14. An intake manifold assembly (not shown) is provided for delivering at least an air charge to the combustion chambers of the respective cylinder bores. A suitable charge forming system, such as manifold type fuel injectors may be associated with the induction system for supplying fuel to the combustion chambers. Although manifold injection is described, it should be readily apparent to those skilled in the art that the invention can be utilized with direct cylinder injection or with carburation, depending upon the desired construction of the engine.

The opposite side of the cylinder head assembly 14 comprises an exhaust side and a suitable exhaust system (not shown) cooperates with this side to collect the combustion products and discharge them to the atmosphere. Referring now primarily to FIG. 2, the cylinder head assembly 14 journals an intake cam shaft 17 and an exhaust cam shaft 18 primarily in the cylinder head members 15. Each of the intake and exhaust cam shafts 17 and 18 has a plurality of respective lobes 19 and 21, which cooperate with valves for the engine 11 that are operated in any suitable manner. Because the valve structure with which the invention can be utilized may be of any known type or any desired type, it has not been illustrated. Also, the system can be utilized with engines having plural valves per cylinder either on the intake or exhaust sides or both. Since the invention deals primarily with the drive for the cam shafts 17 and 18, the remaining valve structure of the engine has not been illustrated and will not be described for the foregoing reason.

It should be noted, however, that the cylinder head 15 has a front-end wall 22 in which the cam shafts 17 and 18 are journalled in a manner, which will be described. There are other bearing surfaces of the cylinder head 14 spaced along the length of the cam shafts 17 and 18 for their journaling.

This drive for the cam shafts is illustrated primarily in FIG. 1 but also appears in FIG. 2. It comprises a first timing drive that includes a timing sprocket 23, which is affixed to the forward end of the crankshaft 13. This portion of the crankshaft 13 extends through the front wall of the engine and forwardly of it and this includes the front cylinder head wall 22. A toothed timing belt 24 of a first timing drive, indicated generally by the reference numeral 25, is engaged with the crankshaft sprocket 23 and with a pair of sprockets 26 and 27 that are associated with the intake and exhaust cam shafts 18 and 17, respectively. A tensioner pulley assembly 28 is mounted on a front wall 29 of the cylinder block 12 and maintains the tension in the drive belt 24 at the desired value. Both of the timing sprockets 26 and 27 have teeth 31 so as to maintain the timed relationship between the crankshaft 13 and the driven cam shafts 18 and 17.

Referring now primarily to FIG. 2, a variable valve timing mechanism 32 is associated with an exhaust cam shaft sprocket 26 and an outer housing member 33, which has a face that is sealingly engaged with the driven pulley 26 via an 0-ring seal 34. An inner housing member 35 is associated with a projecting end 36 of the exhaust cam shaft. The variable valve timing mechanism 32 may be of any known type and is operative to vary the phase relationship between the driven sprocket 26 and the cam shaft end 36. One or more hydraulic passages 37 are provided in the cam shaft 18 and specifically its end portion for actuating the variable valve timing mechanism 32 to vary the phase angle in a well known manner.

In accordance with a feature of the invention, the sprocket 27, which is associated with the intake cam shaft 17, does not directly drive this cam shaft. Rather, the intake cam shaft 17 is driven by a second timing drive, indicated generally by the reference numeral 38, that is disposed on the opposite of the cylinder head wall 22 from the sprockets 26 and 27. This second timing drive comprising a timing gear 39 that is affixed to the exhaust cam shaft 18 or formed integrally with it. This sprocket drives a chain 41, which, in turn, drives a further sprocket 42 that is associated with the intake cam shaft 17 and which drives it in a manner, which will be described shortly. A tensioner mechanism 43 is mounted in the front of the cylinder head assembly 14 and maintains the appropriate tension on the driving chain 41.

Referring now primarily to FIG. 2, a second variable valve timing mechanism 44 is associated with the intake cam shaft 17 and drives the intake cam shaft 17 from a driving sleeve 45 that is affixed to or formed integrally with the driven sprocket 42. This drive sleeve 45 has a driving relationship with the variable valve timing mechanism 44.

The variable valve timing mechanism 44 includes an outer housing member 46, which carries an anti-friction bearing 47 upon which the sprocket 27 associated with the drive belt 24 is journalled. This outer housing member 46 is driven by the drive sleeve 45 and has a connection to an inner member 48 via a phase change mechanism of any known type. This inner member 48 drives the intake cam shaft 17 via a splined connection and thus, the phase angle of the intake cam shaft 17 relative to the exhaust cam shaft 18 is adjusted by the variable valve timing mechanism 44. Again, one or more fluid passages 49 formed in the periphery of the intake cam shaft 17 convey fluid to the variable valve timing mechanism 44 for its operation.

Suitable control valves (not shown) are provided in the cylinder head assembly 14 for controlling the pressurization of the variable valve timing mechanisms 32 and 44 to obtain the desired control strategy.

Figure 3:
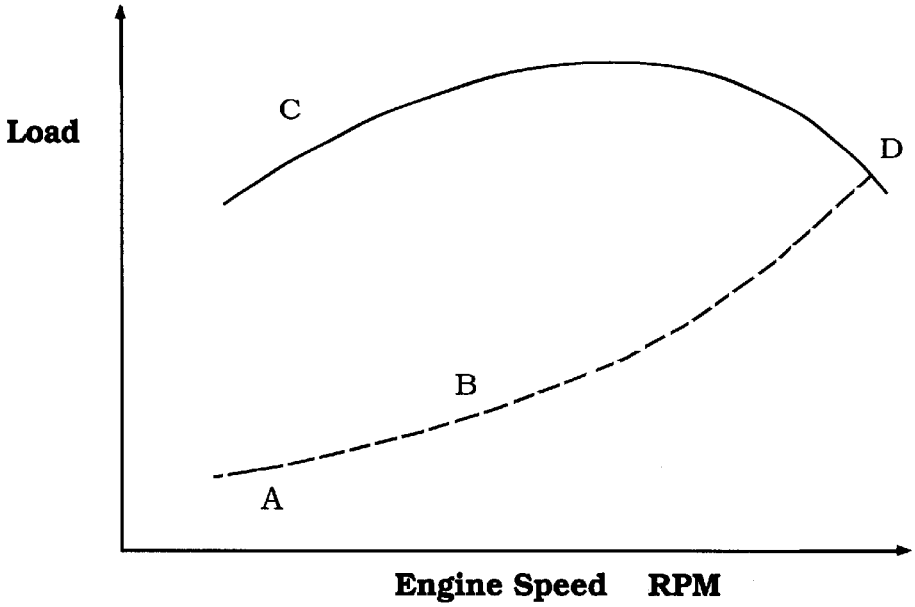
FIG. 3 is a graphical view showing how the torque can be varied relative to engine speed in accordance with certain types of control strategies which are shown in FIG. 4.
Figure 4:
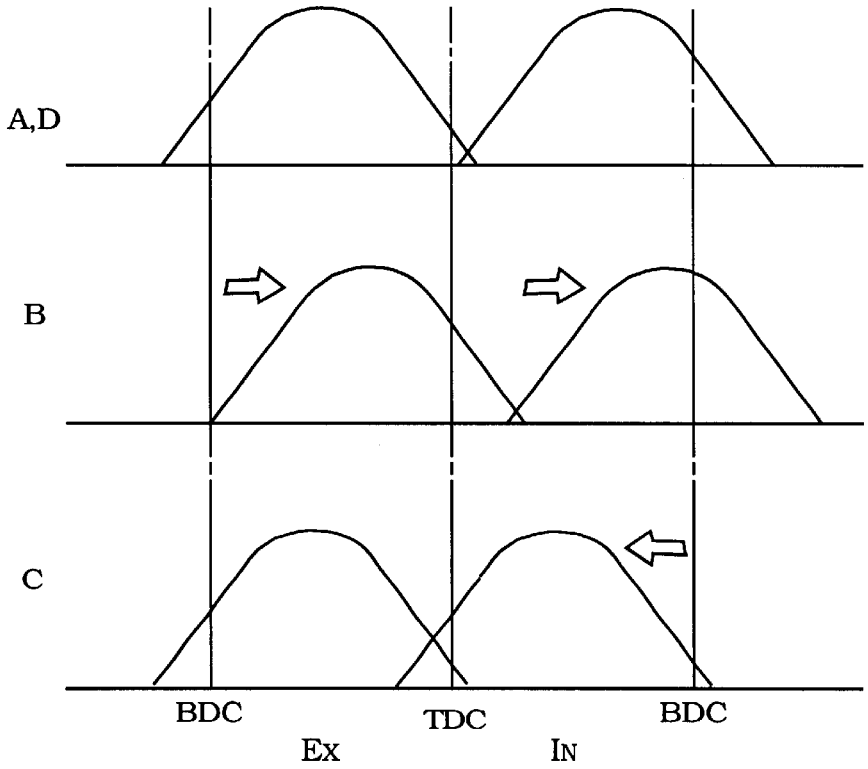
FIG. 4 is a graphical view showing the valve lift in accordance with certain control strategies indicating from top to bottom, the condition when both intake and exhaust valves are operated with conventional timing and conventional lift, when the timing phase of both valves are adjusted simultaneously and in the same direction and same amount, and in the lower view the situation where the timing of one of the valves is adjusted independently of the other.

FIGS. 3 and 4 illustrate the control strategy and the various control phases under which engine performance is improved throughout the engine speed at load ranges in accordance with the invention. Referring first to FIG. 4, the upper view labeled AD, shows the valve timing which is generally conventional and which is utilized with many types of automotive applications. With this type of arrangement, the exhaust valve opens before bottom dead center and continues to be open to a peak occurring some time after bottom dead center and then begins to close as the piston approaches top dead center being fully closed slightly after the piston reaches top dead center.

In a similar manner, the intake valve opens at approximately top dead center and continues to open until some point about half way between top and bottom dead center and then begins to close with full closure occurring some time after bottom dead center. This range of performance is employed in accordance with the control strategy under low speed and idling and low load, low speed operation. This provides good power output, smooth running and good emission control.

However, as the engine moves into the medium load range condition and medium speed, the control strategy moves to the phase shown at B in order to provide a retardation of the opening of the exhaust valves and a light degree of retardation of the opening of the intake valve. In accordance with this embodiment of the invention, this is accomplished by activating the variable valve timing mechanism associated with the exhaust cam shaft 18 in this embodiment which comprises actuating the variable valve timing mechanism 32 so as to retard the timing of opening and closing of the exhaust and intake valves in the same degree and in the same sense. This provides good running in these mid-range conditions.

This is accomplished by actuating only the WT mechanism 32 that is associated with the exhaust cam shaft 18. Since the intake cam shaft 17 is driven by the timing drive 38 interposed between the two cam shafts 17 and 18, the phase of both cam shafts 17 and 18 will be shifted simultaneously at the same degree.

However, when the engine is operating at either the low speed, high load condition or high speed, medium load, the control condition C is utilized. In this condition, and as seen in FIG. 4, the variable valve timing mechanism 32 associated with the exhaust cam shaft 18 is not actuated, but that variable valve timing mechanism 44 associated with the intake cam shaft 17 is actuated so as to affect an advance in the timing of the opening of the intake valve relative to the exhaust valve so as to provide more overlap and a higher power output under this condition.

Thus, it will be seen that this mechanism is operated in a way so that only one or the other of the variable valve timing mechanisms need be operated so as to provide a change in cam shaft timing in order to obtain the desired engine performance. In this way, it is possible to obtain better performance and still use two variable valve timing mechanisms but a simpler control strategy when both variable valve timing mechanisms need be employed to control both cam shafts under most engine operating conditions. It should be apparent from the foregoing description that the described embodiment of the invention provides a very effective and simple variable valve timing mechanism and control strategy whereby performance can be improved under all speed and load ranges while simplifying the variable valve timing mechanism and not employing separate ones for each cam shaft directly and separate control strategies to achieve the desired results. Also by splitting the driving relationship between the cam shafts 17 and 18 for the cam shafts on opposite sides of the front engine wall 22, bending loads on the cam shafts is reduced while still maintaining the possibility of keeping a compact cam shaft drive arrangement. In addition, this permits the use of a belt type transmission for the longer drive to minimize noise while permitting the use of a chain type transmission between the cam shafts to provide a more compact arrangement.

Of course, it is to be understood that the described embodiment is a preferred embodiment. As mentioned earlier, it is also possible to utilize this concept with engines where there are multiple valves that perform either the intake or exhaust functions or both and that the timing of one valve, either intake or exhaust, may be adjusted relative to the timing of the other valve, either intake or exhaust or both can be controlled simultaneously and in the same direction. Therefore, it should be readily apparent to those skilled in the art that various changes and modifications may be made without departing from the spirit and scope of the invention, as set forth in the appended claims.

What is claimed is:

1. An internal combustion engine and cam shaft timing drive comprising an output shaft that is driven by combustion occurring in at least one combustion chamber of said engine, a first cam shaft operating at least one valve associated with said combustion chamber, a second cam shaft operating at least a second valve associated with said combustion chamber, said first and said second cam shafts being journalled at one end thereof by a bearing arrangement formed by said engine, a first cam shaft drive for driving said first cam shaft on one side of said bearing arrangement from said engine output shaft, a first variable valve timing mechanism interconnecting said first cam shaft drive to said first cam shaft for varying the phase angle of said first cam shaft relative to said engine output shaft, a second cam shaft drive provided on the other side of said bearing arrangement from said first cam shaft drive and driving said second cam shaft from said first cam shaft, a second variable valve timing mechanism interposed between said second cam shaft drive and said second cam shaft for varying the phase relationship of said second cam shaft relative to said first cam shaft, and a member directly driven by said first cam shaft drive and associated with said second cam shaft on the other side of the bearing arrangement from said second cam shaft drive.

2. An internal combustion engine as set forth in claim 1, wherein one of the cam shafts operates at least one intake valve and the other of the cam shafts operates at least one exhaust valve.

3. An internal combustion engine and cam shaft timing drive as set forth in claim 1 wherein the member associated with the second cam shaft and directly driven by the first cam shaft drive is journalled by the second variable valve timing mechanism.

4. An internal combustion engine and cam shaft timing drive as set forth in claim 1 wherein the first cam shaft drive is positioned externally of the engine body defining the engine combustion chamber.

5. An internal combustion engine and cam shaft timing drive as set forth in claim 1 both of the cam shaft drives comprise flexible transmitters.

6. An internal combustion engine and cam shaft timing drive as set forth in claim 5 wherein the first cam shaft drive comprises a toothed belt and the second cam shaft drive comprises a chain.

7. An internal combustion engine and cam shaft timing drive as set forth in claim 6 wherein the member directly driven by the first cam shaft drive comprises a sprocket associated with the second cam shaft.

8. An internal combustion engine and cam shaft timing drive as set forth in claim 7 wherein the sprocket associated with the second cam shaft and driven by the first cam shaft drive is journalled by the second variable valve timing mechanism.

* * * * *